US008678017B2

(12) United States Patent
Arpey et al.

(10) Patent No.: US 8,678,017 B2
(45) Date of Patent: Mar. 25, 2014

(54) HAIRSTYLING AND STYLE HOLDING ACCESSORY

(75) Inventors: Catherine Arpey, Atlanta, GA (US); Stan Chudzik, Alpharetta, GA (US)

(73) Assignee: Goody Products, Inc., Atlanta, GA (US)

( * ) Notice: Subject to any disclaimer, the term of this patent is extended or adjusted under 35 U.S.C. 154(b) by 0 days.

(21) Appl. No.: 13/589,898

(22) Filed: Aug. 20, 2012

(65) Prior Publication Data

US 2013/0042880 A1 Feb. 21, 2013

Related U.S. Application Data

(60) Provisional application No. 61/525,603, filed on Aug. 19, 2011.

(51) Int. Cl.
*A45D 24/38* (2006.01)

(52) U.S. Cl.
USPC ..... 132/144

(58) Field of Classification Search
USPC ..... 132/219, 101, 107, 120, 127, 130, 132, 132/144, 146, 148; D28/21, 25
See application file for complete search history.

(56) References Cited

U.S. PATENT DOCUMENTS

| | | | | |
|---|---|---|---|---|
| D459 | S * | 5/1852 | Redheffer | D28/33 |
| 757,204 | A | 4/1904 | Koenig | |
| 849,766 | A | 4/1907 | Baker | |
| 914,984 | A | 3/1909 | Speck et al. | |
| 5,787,904 | A * | 8/1998 | Michaud | 132/200 |
| 6,123,086 | A | 9/2000 | Kuglen | |
| 6,209,549 | B1 | 4/2001 | Lunde | |
| 7,013,900 | B2 | 3/2006 | Silva | |
| 7,017,589 | B1 | 3/2006 | Minnelli | |
| 7,621,279 | B1 * | 11/2009 | Anagnostou | 132/144 |
| 2004/0103909 | A1 * | 6/2004 | Silva | 132/148 |
| 2005/0199255 | A1 * | 9/2005 | Silva | 132/144 |
| 2010/0132729 | A1 | 6/2010 | Kuglen et al. | |

* cited by examiner

*Primary Examiner* — Rachel Steitz
(74) *Attorney, Agent, or Firm* — Lempia Summerfield Katz LLC

(57) ABSTRACT

A hairstyling accessory has an elastic band and a comb with bridge extending laterally across the comb. A plurality of tines protrudes longitudinally from one edge of the bridge generally parallel to and spaced apart from one another. A connector has an opening on the bridge and a tongue coinciding with the opening. A portion of the elastic band is received in the opening and around the tongue and the majority of the elastic band extends from the comb.

18 Claims, 9 Drawing Sheets

30
32
34
36
38
40
42
44
46
48
50
60
62
64
66
68
70
72
80
82
B
F

HAIRSTYLING AND STYLE HOLDING ACCESSORY

RELATED APPLICATION DATA

This patent is related to and claims priority benefit of U.S. provisional patent application Ser. No. 61/525,603 filed on Aug. 19, 2011 and entitled "Volume Up Hair Accessory." The entire content of this prior filed application is hereby incorporated herein by reference.

BACKGROUND

1. Field of the Disclosure

The present disclosure is generally directed to hair styling accessories and styling aids, and more particularly to a hairstyling accessory that aids in creating and holding a ponytail hairstyle with the appearance of having more volume.

2. Description of Related Art

A ponytail is a known and very popular hairstyle. A person's hair is pulled away from the face, then gathered together and secured in a bundle at the middle behind their head. A simple tie, clip, or rubber band is often used to secure the hair in a pony tail style. The ponytail style can be altered by gathering the hair offset to one side or the other of the person's head instead of in the middle at the back of their head. The ponytail can be flipped upwards or the focal point of the pony tail can be positioned higher or lower on the person's head to alter the direction in which the hair projects from the person's head. One problem with a ponytail hairstyle, particularly when flipped upwards or located high on the back of the person's head, is that medium, fine or thinning hair can appear sparse instead of full and thick or voluminous.

Hairstyles as seen at red carpet events, on fashion runways, and in fashion magazines may indicate that an enhanced volume hairstyle is becoming a trend. Others have tried to develop hairstyles or styling accessories or products that make a person's hair appear to have more volume than it actually has. These methods and products have met with varying degrees of success.

One hair accessory is known as "The Puffy Pony®" and has been commercialized by a company called Mia Hair Accessories. The Puffy Pony product is disclosed in U.S. Pat. No. 7,017,589. The '589 patent discloses a method of installing a hair accessory to enhance the volume or appearance of volume of a ponytail. In the '589 patent, the product has an elastic band and a comb. The elastic band is separate from the comb and is applied to a person's hair before the comb is placed in their hair.

In another example, U.S. Pat. No. 7,013,900 discloses a hair comb for placement in a person's hair to secure the hair. A number of embodiments are disclosed in the '900 patent that utilize a secondary holder to then capture hair to be styled between the comb and the secondary holder. The secondary holders include various examples of bands that are attached to the comb and that can stretch over hair and then connect to another part of the comb. In another example, the secondary holder is a plastic or flexible "arm" on the comb that captures hair between the arm and comb and then hooks onto another part of the comb to hold the hair. The comb, when placed and secured, is said to increase the volume of the hair in the style created. One problem with the accessories disclosed in the '900 patent is that they can slide through hair and thus do not easily stay in place. Another problem is that the accessories of the '900 patent do not securely contain or hold the hair.

SUMMARY

In one example according to the teachings of the present invention, a hairstyling accessory has an elastic band and a comb with a bridge extending laterally across the comb. A plurality of tines protrudes longitudinally from the bridge and spaced apart from one another. A connector has an opening on the bridge and a tongue coinciding within the opening. A portion of the elastic band is received in the opening and around the tongue and the majority of the elastic band extends from the comb.

In one example, the opening can be a U-shaped opening through the bridge.

In one example, the tongue can project partially across the opening giving the opening a U-shape.

In one example, the connector can have a groove formed across a base of the tongue on one side and the portion of the elastic band can lie in the groove.

In one example, a surface of the bridge can have two grooves spaced apart from one another adjacent the connector and segments of the elastic band can lie in the two grooves.

In one example, two grooves can be formed in a surface of the bridge adjacent the connector and can be generally parallel to the plurality of tines. Segments of the elastic band can lie in the two grooves.

In one example, a surface of the bridge can have two grooves spaced apart from one another adjacent the connector and segments of the elastic band can lie in the two grooves. The connector can also have a tongue groove formed across a base of the tongue on a side of the comb opposite the two grooves and the portion of the elastic band can lie in the tongue groove.

In one example, the hairstyling accessory can have a plurality of fins protruding from a surface of the bridge in a direction different than the tines.

In one example, the plurality of tines can each have a rounded contour.

In one example, the bridge can be curved in a widthwise direction.

In one example, the plurality of tines can be curved in a direction end to end over their length.

In one example, the tongue can project across the opening producing a U-shape and the opening can have side portions along sides of the tongue and an end portion at a free end of the tongue. The side portions can be wider than the end portion.

In one example, the opening can be U-shaped with side portions and an end portion and the elastic band can have a cross-section diameter that is larger than at least a size of the end portion In one example, the tongue can be oriented generally parallel to the plurality of tines.

In one example according to the teachings of the present invention, a hairstyling accessory has an elastic band and a comb with a bridge extending laterally across the comb. A plurality of tines protrudes longitudinally from the bridge and spaced apart from one another along the bridge. A plurality of fins protrudes from the bridge and is spaced apart from one another over a length of the bridge. The plurality of fins protrudes from the bridge in a different direction than the plurality of tines. A connector has an opening through the bridge and a tongue projecting partially across the opening. A portion of the elastic band is received through the opening and around the tongue and a majority of the elastic band extends from the comb.

In one example, the plurality of fins can each have a length greater than a width and can be oriented lengthwise generally parallel with the plurality of tines.

In one example, the hairstyling accessory can have two grooves on a surface of the bridge and spaced apart from one another adjacent the connector. A tongue groove can be formed across a base of the tongue on a side of the comb opposite the two grooves. The portion of the elastic band can lie in the tongue groove and segments of the elastic band can lie in the two grooves.

In one example, the hairstyling accessory can have two grooves on a surface of the bridge and spaced apart from one another adjacent the connector. The two grooves can be generally parallel to the plurality of tines. A tongue groove can be generally perpendicular to the plurality of tines.

In one example, the comb can be formed as a one-piece molded plastic structure and the elastic band can be removably replaceable on the comb.

In one example according to the teachings of the present invention, a method of creating a ponytail hairstyle includes providing an elastic band and a comb having a bridge and a plurality of tines protruding longitudinally from and spaced apart from one another along the bridge. A portion of the elastic band is inserted within an opening on the bridge and around a tongue that coincides with the opening to connect the elastic band to the comb. A bundle of hair to be styled is grasped and the elastic band is wrapped around the bundle of hair. The tines are embedded into the hair under the bundle of hair and then the bundle of hair is draped over the comb.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The disclosed hairstyling accessories solve or improve upon one or more of the above-noted problems and disadvantages with prior know hairstyling accessories. In one example, the disclosed hairstyling accessories have a hairstyling comb for holding hair in a particular style and an elastic band for holding a bundle of hair. In one example, the disclosed hairstyling accessories allow for connecting the elastic band to the comb. In one example, the elastic band can be easily connected to, removed from, and replaced on the comb. In one example, the disclosed combs and elastic bands, when connected, can be used in a person's hair to create a volume enhancing ponytail hairstyle. In one example, the disclosed combs can include a plurality of conventional tines and a plurality of fins each projecting from a bridge or spine of the comb. The fins can be configured to retain hair lying against the bridge or spine of the comb in position along a length of the bridge or spine. These and other objects, features, and advantages of the disclosed hairstyling accessories will become apparent to those having ordinary skill in the art upon reading this disclosure.

As used herein, the terms, "length", "width", "height", "depth", "front", "back", "top", "bottom", "side", and the like applied for creating reference in describing relationships between parts or portions of the hairstyling accessories. The disclosed hairstyling accessories are not necessarily intended to be limited to the specific way in which these types of reference terms are applied herein.

Figures 1, 2, 3:
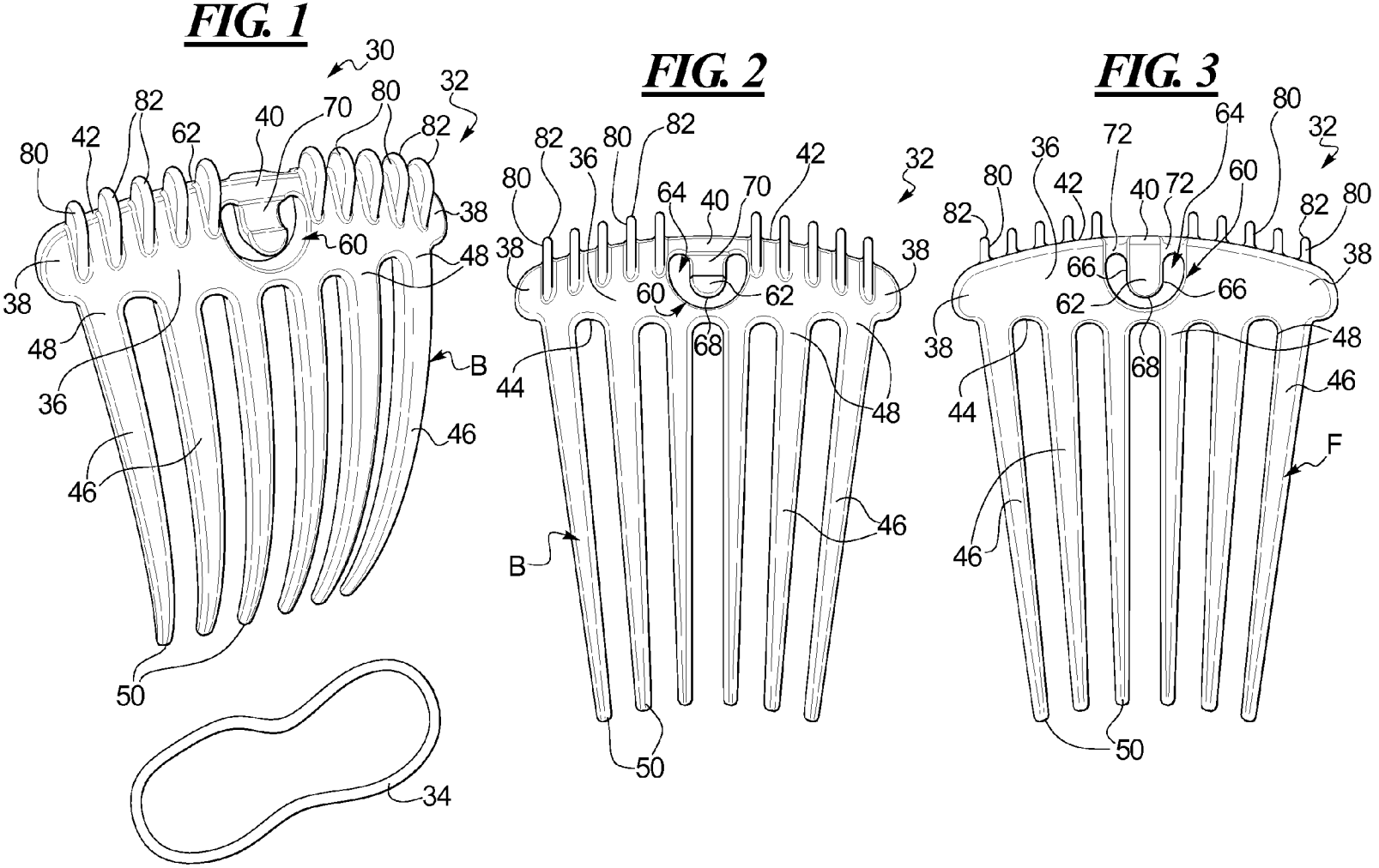
FIG. 1 shows a perspective view of one example of a hairstyling accessory constructed in accordance with the teachings of the present invention.
FIG. 2 shows a front view of the comb of the hairstyling accessory of FIG. 1.
FIG. 3 shows a rear view of the comb of FIG. 2.

Turning now to the drawings, FIG. 1 show one example of a hairstyling accessory 30 constructed in accordance with the teachings of the present invention. The hairstyling accessory 30 has a comb 32 that is configured as a hairstyling or hairstyle holding type comb. The hairstyling accessory 30 also has an elastic band 34, which is a continuous hoop, loop, or ring comprised of an elastic, resilient, stretchable material. The basic shape and construction of the comb 32 and elastic band 34 can vary within the spirit and scope of the present invention. Several of many possible alternative examples are discussed below.

With reference to FIGS. 1-5, the comb 32 generally has a bridge or spine 36, hereinafter the bridge 36, at a top end of the comb 32. The bridge 36 has a pair of free ends 38 and a mid-portion 40 between the free ends. The bridge 36 extends laterally across a width of the comb. In this example, the bridge 36 is curved in at least two respects. A top edge 42 of the bridge 36 has a convex curve such that it is higher at the mid-portion 40 than at the free ends 38 (see FIGS. 2, 3, and 4). However, a bottom edge 44 of the bridge 36 is generally straight or linear in this example. The bridge 36 also has a concave curvature viewed from a front F of the comb 32 (see FIGS. 2 and 5) and a convex curvature viewed from a back B of the comb. Thus, the free ends 38 are further forward than the mid-portion 40 in this example.

The comb 332 also generally has a plurality of tines 46 extending downward from the bottom edge 44 of the bridge 36. In this example, the tines 46 extend generally perpendicular relative to the bottom edge 44, and thus extend in a lengthwise or longitudinal direction of the comb 32. The tines 46 are tapered so as to be wider at a proximal or upper end 48 and thinner at a distal or lower end 50. The tines 46 are also configured to be generally parallel to and spaced apart from one another. Generally parallel, as used herein, includes the tines being not quite parallel, as the tines become slightly closer to one another near their lower ends 50 in this example. The tines 46 are also in two respects in this example. The tines 46 have a convex curve viewed from the front (see FIGS. 2 and 4), curving from end-to-end. The tines 46 are also attached to the curved bridge 36 so that they do not lie in the same, flat plane. Instead, the tines 46 are positioned such that the center most tines 46 are further rearward and the side or edge most tines 46 are further forward (see FIGS. 4 and 5) on the comb.

The disclosed comb 32 has a curved shape that may help in installing or inserting the comb in a person's hair during styling. The curve allows for a natural arcuate or digging motion when inserting the comb in a person's hair. However, different curvatures for both the bridge 36 and tines 46 are certainly possible. For example, the degree of curvature of either or both the bridge 36 and tines 46 can be altered. Alternatively, the tines 46 and/or the bridge 36 can each have a complex curve of varying radius or even varying direction. In another alternative, the bridge 36 and/or the tines 46 can be flat or straight and not curved at all.

The comb 36 can be formed of any suitable material and of any process suitable for that material. In one example, the comb 36 can be injection molded from a plastic material, such as an ABS plastic resin. Alternative resins can also used, such as Polystyrene, Polypropylene, Polyethylene, Polycarbonate, Kostrate®, High Impact Polystyrene, Polyethylene Terephthalate, and the like. The comb 36 can also be formed of a softer durometer material to provide potentially more flexibility in the comb when coming in contact with the scalp of the wearer. For example, TPE, TPU, PVA, EVA, Neoprene, Santoprene, and the like are other possible comb resin materials. The bridge 36 could be molded of one material to enhance a user's grip or could be over-molded or dual molded with a softer durometer material than the tine material, if desired. In other examples, the comb 36 can be formed of a metal material, such as carbon steel, stainless steel, silver, gold, bronze, or the like. The potential to die-cast or cast the comb 36 would allow for metal alloys to be introduced, such as magnesium zinc, tin, aluminum, "pot metal", lead, or the like. In yet another example, the comb 36 could be formed of wood or could be die-cut or stamped out of any one of the above-noted materials, if desired.

The elastic band 34 (see FIG. 1) can be a braided elastic band with a core of a Polyisoprene, synthetic rubber, or the like. The core can be surrounded by a thread layer of cotton, chenille, wool, nylon, polyester, polypropylene, Lycra, Spandex, or the like. The thread layer material and construction can be formed in such a manner so as to provide an enhanced gripping function between hair and the band, if desired. The elastic band can also be UV resistant and can be resistant to harm or damage from specific chemicals such as chlorine, aerosol alcohols, hair dyes, hair shampoos, hair conditioners, and the like. The size of the elastic band can vary. In one example, the elastic band can be a ring having a 48 mm outside diameter. The ring material can also vary in shape and size. In one example, the ring material can have a circular cross-sectional shape with a diameter of about 4 mm. In other examples, the ring material can have a cross-sectional diameter of less than 1 mm up to about 6 mm or more. The cross-sectional shape does not have to be circular, and instead can be triangular, rectangular, octagonal, or other such shapes.

In the disclosed example, the elastic band 34 is removably connected to the comb 32. Thus, the elastic band 34 can be attached to the comb 32 for use, can be removed from the comb, and/or can be replaced if damaged or broken or if a user wishes to mix and match bands and combs. Both the elastic band 34 and the comb 32 can be provided of different colors to alter the aesthetic appearance of the hairstyling accessory 30.

Figures 4, 5, 6, 7:
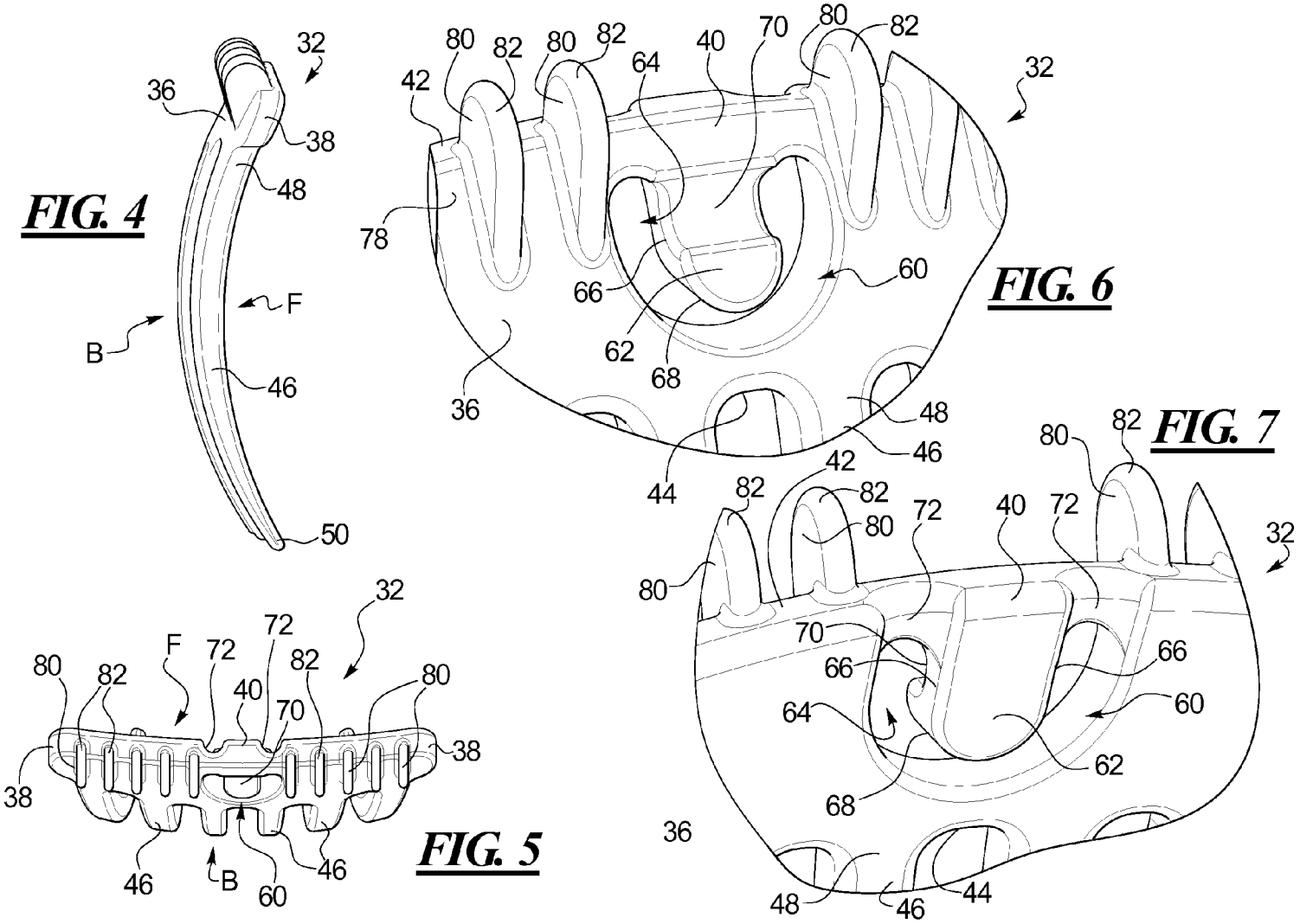
FIG. 4 shows a side view of the comb of FIG. 2.
FIG. 5 shows a top end view of the comb of FIG. 2.
FIG. 6 shows a close up perspective view of a front side of a connector of the comb of FIG. 2.
FIG. 7 shows a close up perspective view of a rear side of the connector of FIGS. 3 and 5.

With reference to FIGS. 6 and 7, the comb 32 has a connector 60 configured to removably attach the elastic band 34 to the comb. In this example, the connector 60 is provided on the bridge 36 at the mid-portion 40. A tongue 62 is provided on the bridge 36 and is configured to receive a portion of the elastic band 34 when connected. An opening 64 is provided in the bridge 36 so that the elastic band can hook onto the tongue 62. In one example, the opening 64 can be a recess in the bridge 36 under a portion of the tongue 62. However, in the disclosed example, the opening 64 is a through-hole formed completely through the bridge 36. The tongue 62 protrudes partially across the opening and has a pair of opposed sides 66 and a free end 68. The space that essentially surrounds the tongue gives the opening 64 a U-shape. In this example, the tongue 62 protrudes downward in the direction of the tines 46. This is so that the elastic band 34 hooks onto the tongue 62 and is retained in a direction and the manner needed for use of the hairstyling accessory 30.

In this example, the gap between the material of the bridge 36 and tongue 62 at the sides 66 of the tongue are larger than the gap between the free end 68 of the tongue and the bridge material. Thus, the opening 64 is smaller at the free end 68 of the tongue 62 than at the sides 66. A first groove 70 or recess is formed laterally across a back side of the tongue 62 in this example. The groove 70 is positioned near the base or proximal end of the tongue 62. The groove 70 has a size and shape or contour that is configured to match the cross sectional shape of the elastic band 34. In this example, the elastic band 34 has a circular cross-section so the groove 70 has a semi-circular curvature of about the same diameter as the band. A pair of second grooves 72 or recesses is formed on the front side of the bridge 36. The second grooves 72 are spaced apart from one another on opposite sides of the tongue 62 and generally aligned with the portions of the opening 64 along the sides 66 of the tongue. The second grooves 72 are similar in size, depth, and contour to the first groove 70 so as to also generally match the characteristics of the elastic band 34. In this example, the second grooves 72 are generally perpendicular to the first groove and are thus aligned in the same direction as and parallel with the tines 46.

Figure 9:
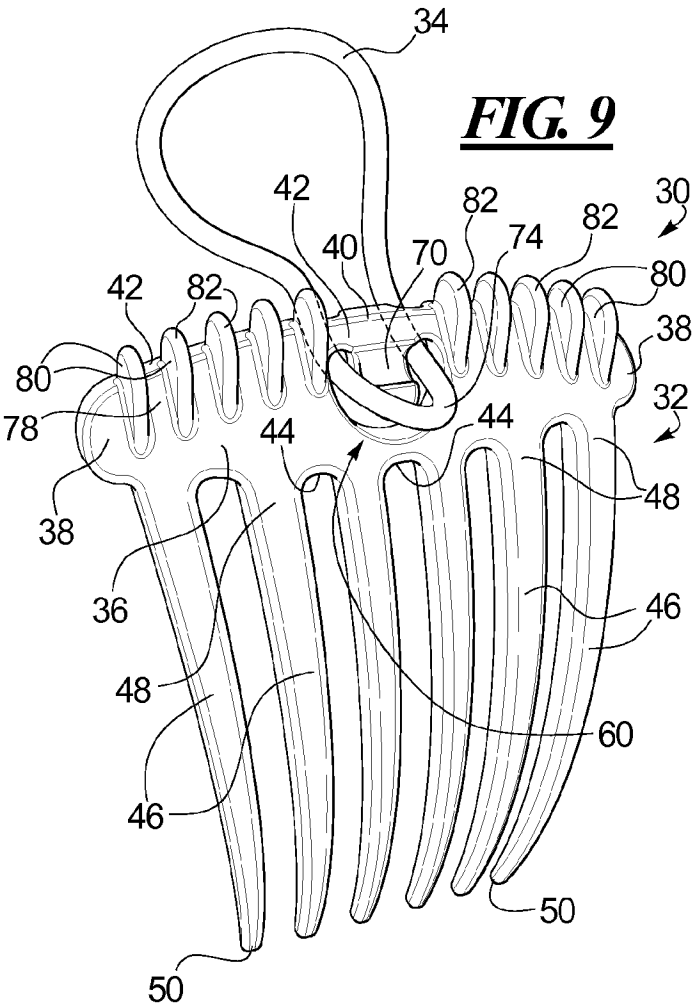
FIG. 9 shows the portion of the elastic band pulled through the opening.
Figure 8:
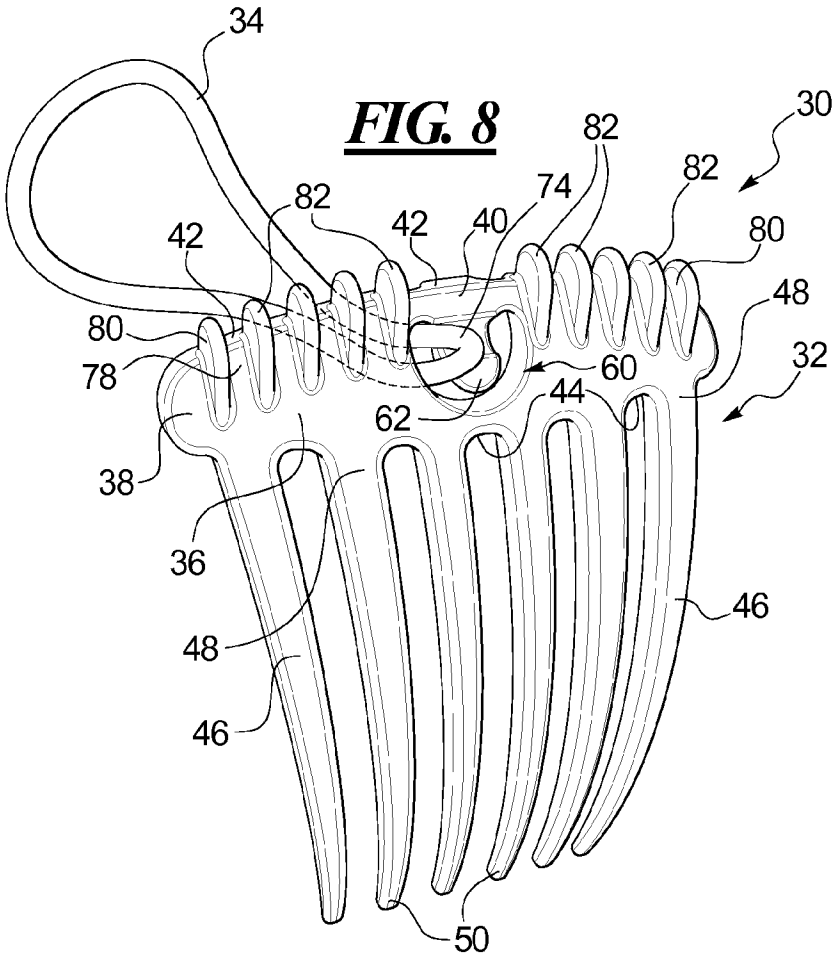
FIG. 8 shows the connector of FIG. 7 with a portion of the elastic band of FIG. 1 being inserted through an opening of the connector.
Figure 10:
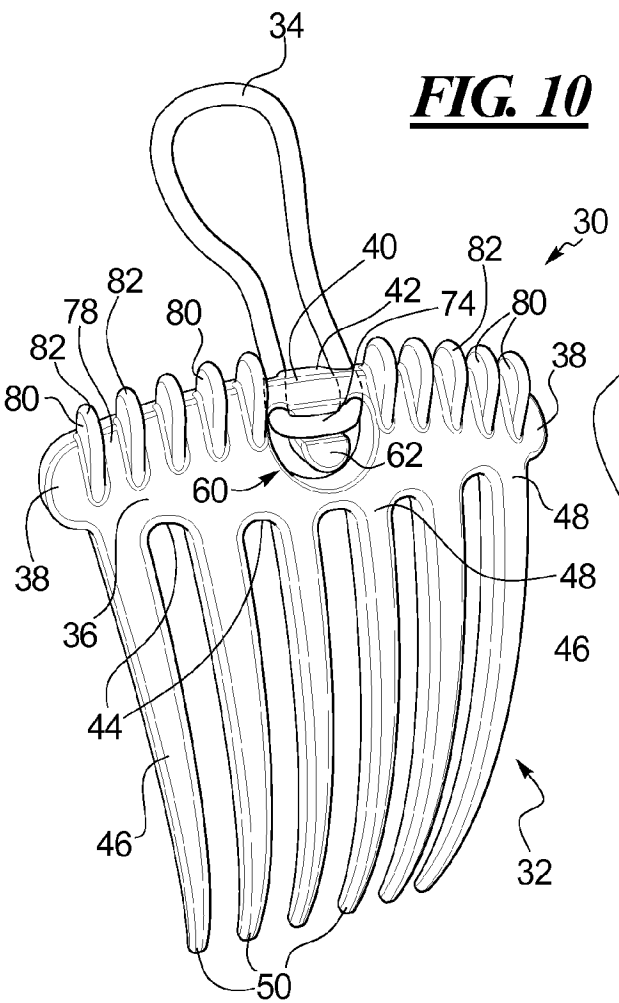
FIG. 10 shows the portion of the elastic band pulled taught and received around a tongue of the connector.

As shown in FIGS. 8-10, the elastic band 34 can be easily attached to the comb 32 using the connector 60. First, a portion 74 of the elastic band is squeezed through one of the larger gaps of the opening 64 adjacent the sides 66 of the tongue as shown in FIG. 8. The portion 74 of the elastic band 34 is then pulled further through the opening 64 as shown in FIG. 9 so that the elastic band can be threaded or hooked around the back side of the tongue 62. The other end, i.e., the majority of the elastic band 34 will protrude from the front side of the comb 32. This end can be pulled taught, which will drawn the portion 74 across the back side of the tongue 62 and into the first groove 70 as shown in FIG. 10. The first groove 70 thus acts as a retaining groove to help retain the elastic band in this position around the tongue 62. As discussed below, the second grooves 72 will act as guide grooves to aid in keeping the elastic band 34 in the mid-portion 44 of the bridge during use.

As mentioned above, the configuration and construction of the connector 60 can vary and yet function as intended. In this example, the connector 60 is provided to allow for the elastic band 34 to be attachable to and detachable from the comb 32, as needed. The orientation and shape of the tongue 62 can vary, as can that of the opening 64. The opening 64 need not be a through opening as long as the elastic band can be secured to the comb in a removable manner. Also, the grooves can be eliminated or can vary in shape, depth, and the like.

In the disclosed example, the hairstyling accessory 30 also has a plurality of teeth or fins 80 that protrude from a surface of the bridge 36. In this example, the fins 80 protrude rearward and upward at an angle from a back side 78 of the bridge and at least in part from the top edge 42. The fins 80 should at least protrude in a different direction than the tines 46. In this example, the fins 80 are spaced apart across the back side of the bridge 36 and are oriented to be generally parallel or aligned lengthwise with the tines 46. A peripheral edge 82 of each of the fins 80 has a rounded contour both widthwise and over the length of the exposed fin periphery. The rounded contour will inhibit the fins 80 from unintentionally grabbing or pulling a user's hair when the hairstyling accessory 30 is being used.

The placement and size of the fins 80 should be such to keep hair strands passing over the bridge 36 captured between adjacent fins during use. When hair is draped over the bridge 36 of the hair accessory 30 during use, the hair may slide off the bridge 36 and reveal the accessory. This may be undesirable. Thus, the fins 80 can be provided to assist the hairstyling accessory 30 in retaining a hairstyle once created and to prevent unwanted exposure of the hair accessory.

FIGS. 11-18 are provided to illustrate a method of creating an enhanced volume ponytail hairstyle using the disclosed hairstyling accessory 30. A number of steps are performed to properly place the hair accessory 30 in the hair and to properly place the hair relative to the accessory. First, the user can attach an elastic band 34 to the comb 32, if needed and as shown in FIGS. 8-10. The user can then install the hair accessory 30 to create an enhanced volume or "volume up" ponytail style.

Figure 11:
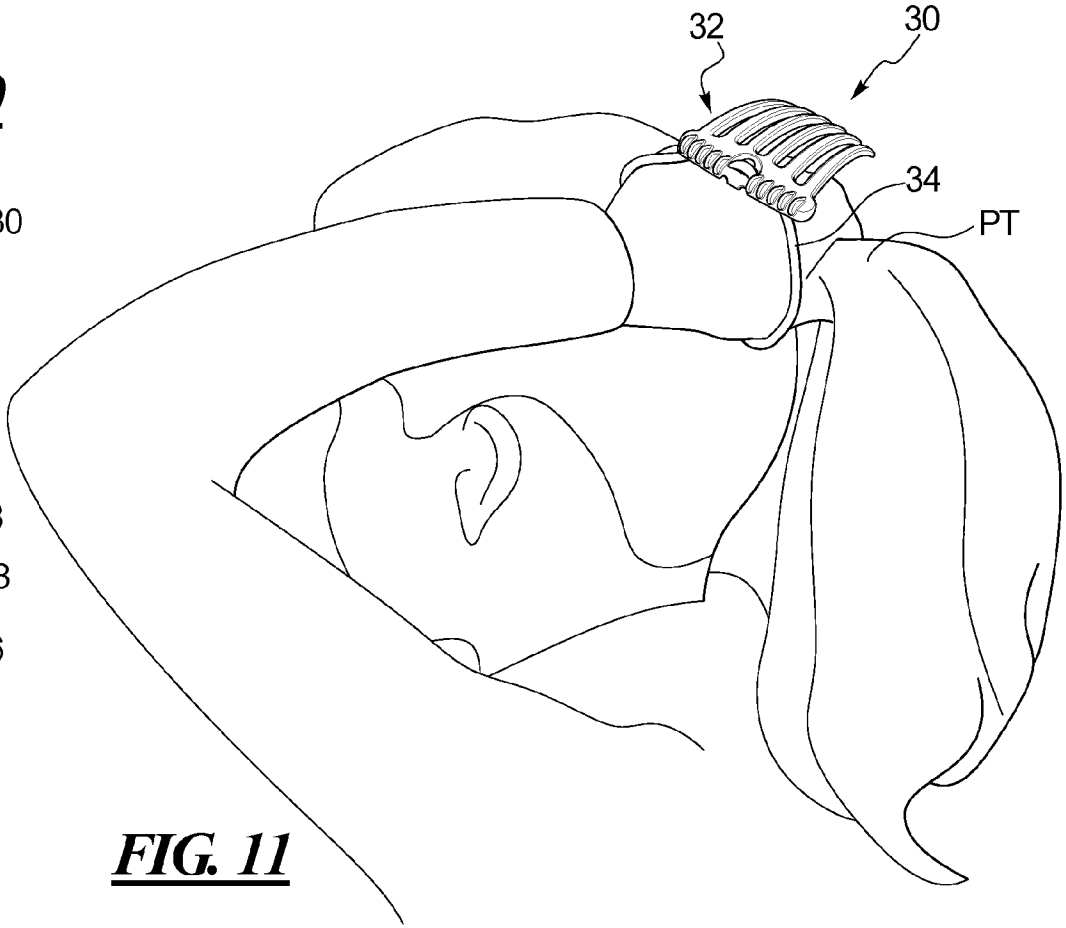
FIG. 11-18 show method steps for using the hairstyling accessory of FIG. 1 and for creating a ponytail hairstyle with increased volume.
Figure 13:
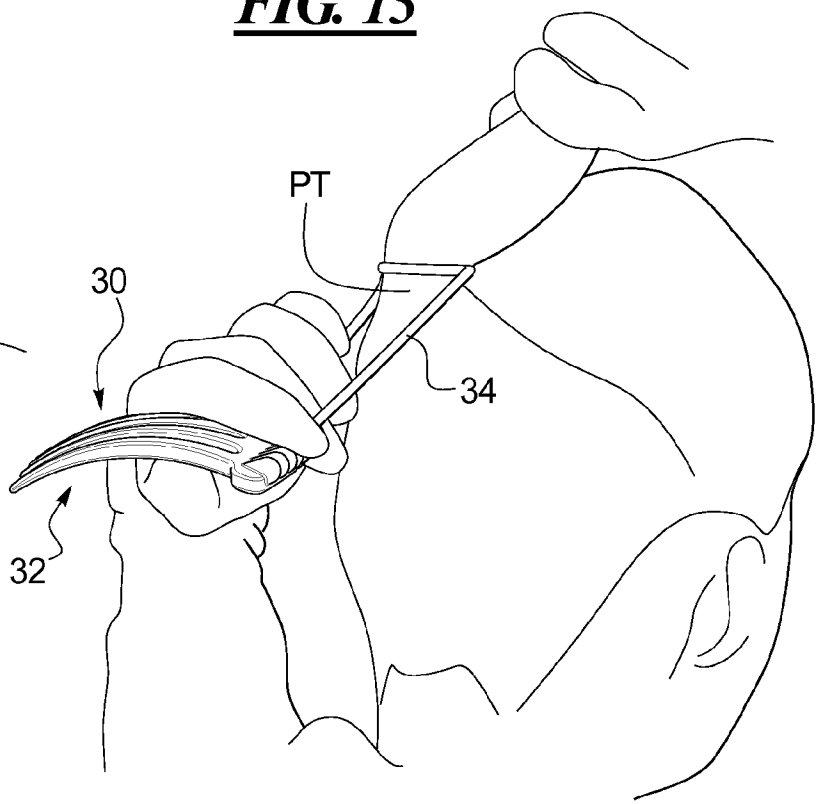
Figure 12:
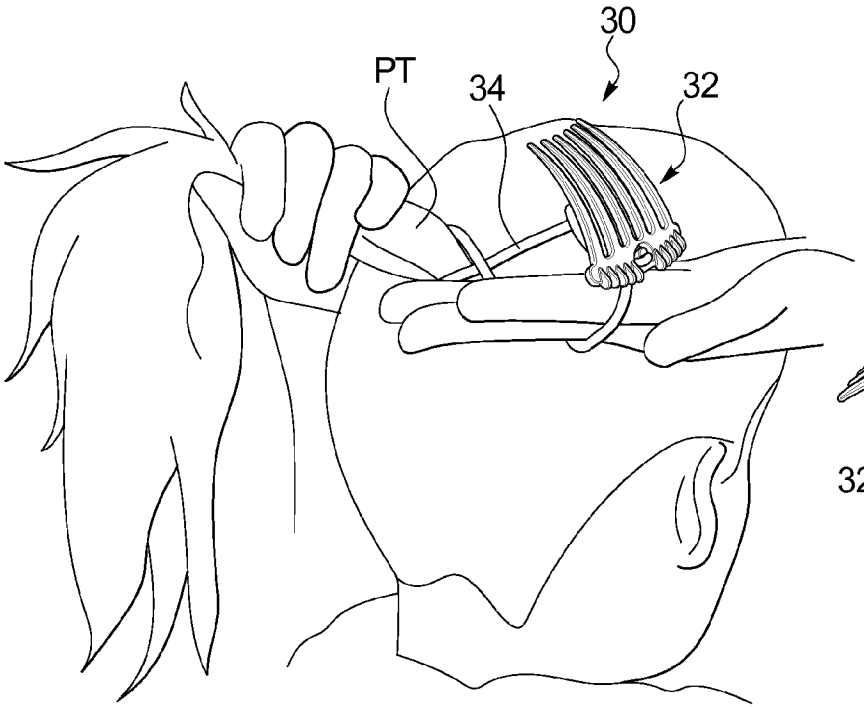
Figure 15:
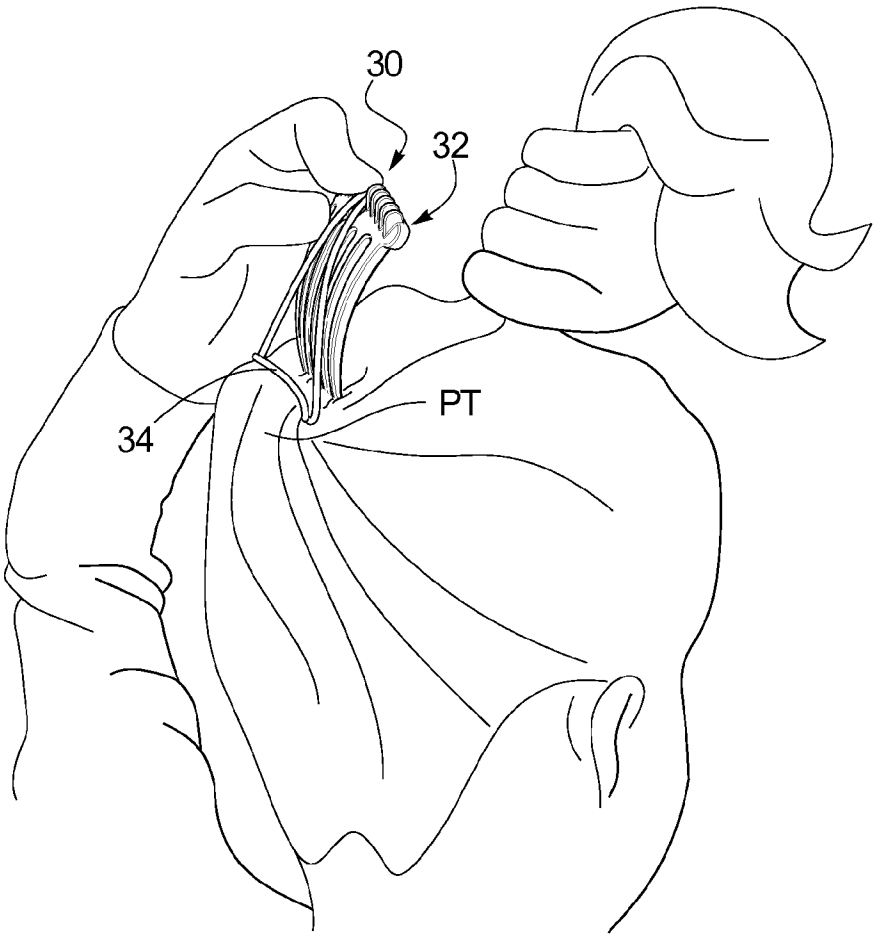
Figure 14:
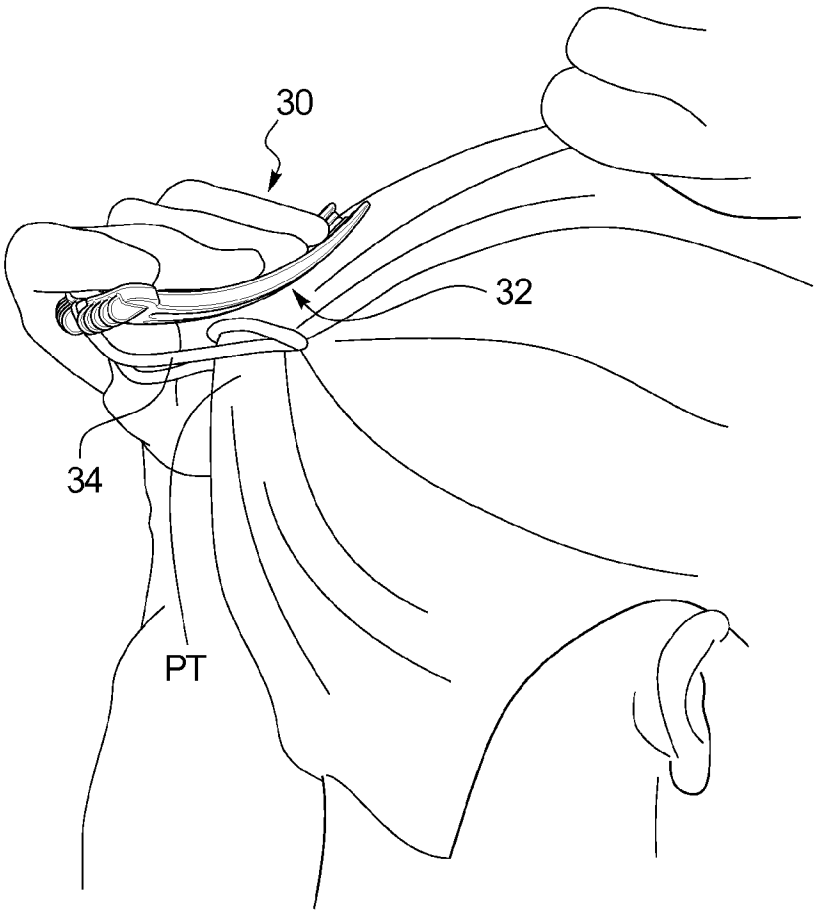
Figure 17:
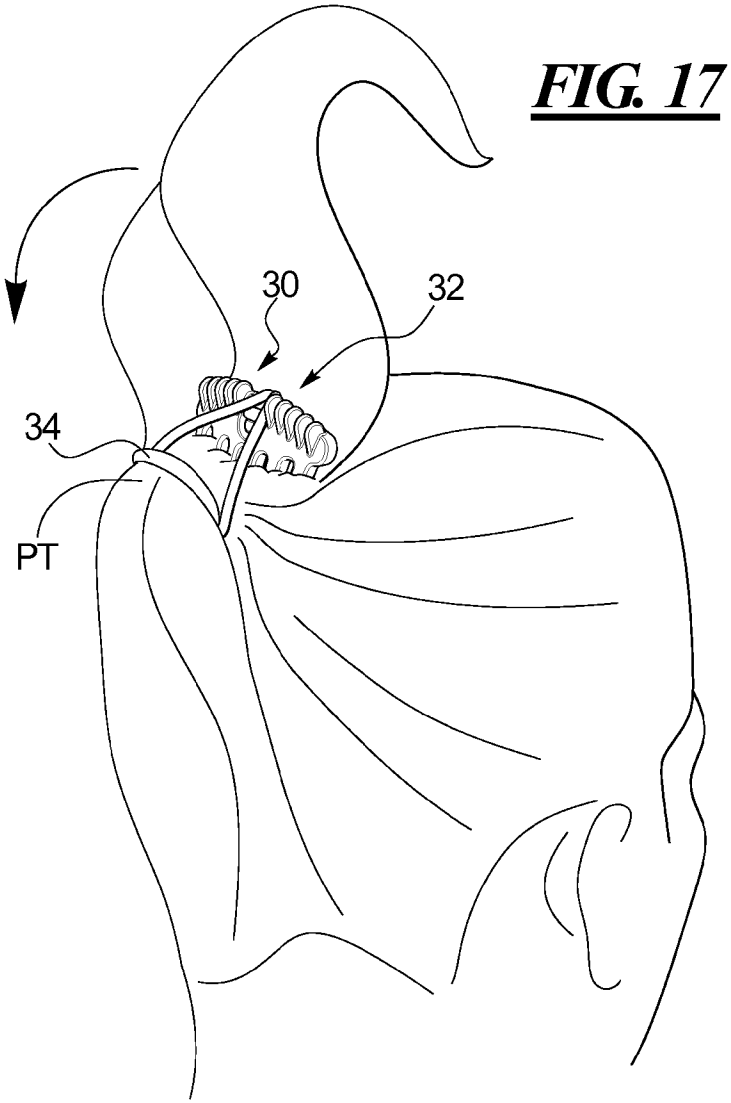
Figure 16:
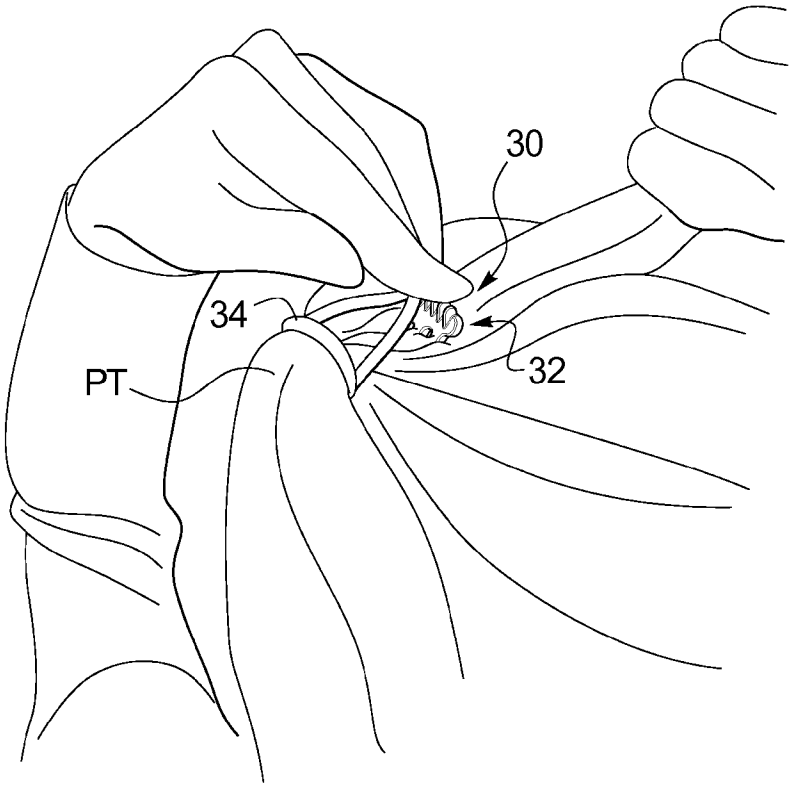
Figure 18:
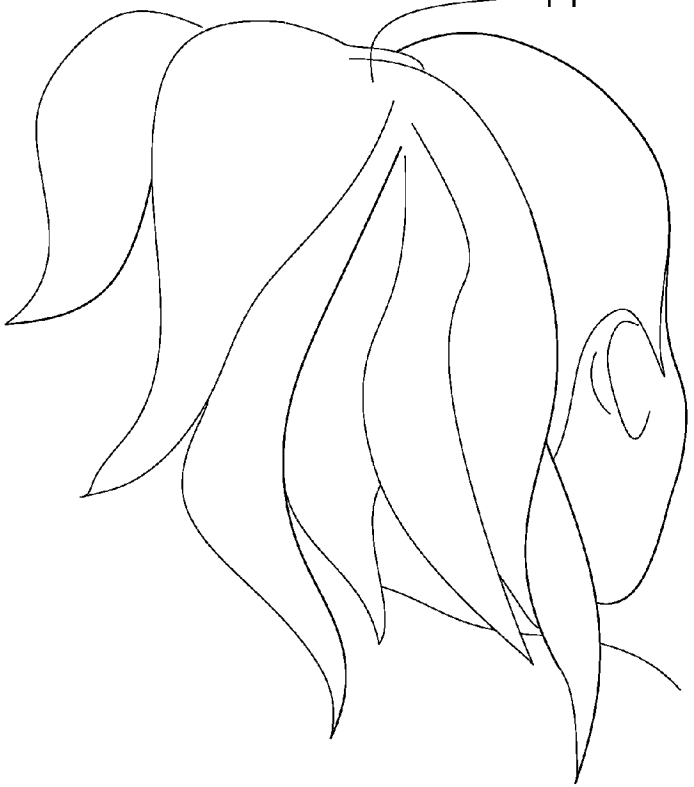

As shown in FIG. 11, a user first wraps the elastic band 34 around one hand and gathers up a bundle PT of their hair with that hand. As shown in FIG. 12, the user then pulls the hair bundle PT through or slides or wraps the loop around the hair bundle as they release the loop from their hand. The user then also twists the elastic band 34 to prepare for another loop. As shown in FIG. 13, the hair bundle PT is then inserted into the second loop of the stretched elastic band 34, which secures the hair in a ponytail and places the comb below the ponytail bundle. As shown in FIG. 14, the ponytail bundle PT is pulled forward and the comb 32 is positioned over the hair with the concave front side F of the comb facing upward away from the scalp. As shown in FIG. 15, the comb 32 is then rotated upward with the tines 46 pointing down into the hair and in front of the elastic band 34 around the ponytail bundle PT. The bridge 36 of the comb 32 is then pushed down, which buries or embeds the tines 46 in the user's hair under the pony tail bundle PT, as shown in FIGS. 16 and 17. The user's bundle of hair PT can then be lifted up and rotated rearward as shown in FIG. 17. The user's hair bundle PT can then be draped over the bridge 36 of the comb 32, back down over the back of their head, and fanned or spread out, as shown in FIG. 18. The hairstyling accessory 30 is thus hidden beneath the user's hair. The elevated position of the comb 32 raises the ponytail height creating an enhanced volume look. The ponytail hair is spread out across the user's head and hides the hairstyling accessory 30. In this example, the fins 80 are facing rearward and help to retain the draped hair on the bridge 36, which prevents the hair from sliding sideways across the bridge, which would otherwise expose the comb 32 and elastic band 34.

As noted above, the hairstyling accessory 30 can vary from the example shown and described above. In one example shown in FIG. 19, a hairstyling accessory 100 has a comb 102 with an elastic band 104. In this example, the comb 102 has a bridge 106 with no fins on it. The hairstyling accessory 100 is otherwise the same as the hairstyling accessory 30 as described above. In another example shown in FIG. 20, a hairstyling accessory 110 has a comb 112 and an elastic band 114. The comb 112 in this example again has no fins and is also of a larger size than that previously described. The comb 112 has a bridge 116 that is wider than the earlier described bridge 36 and carries seven tines 118 instead of five tines 46 on the earlier described comb 32. These examples thus illustrate that the size of the comb can vary within the spirit and scope of the invention, as can the presence or absence of the fins on the bridge and/or the quantity of tines.

Figure 23:
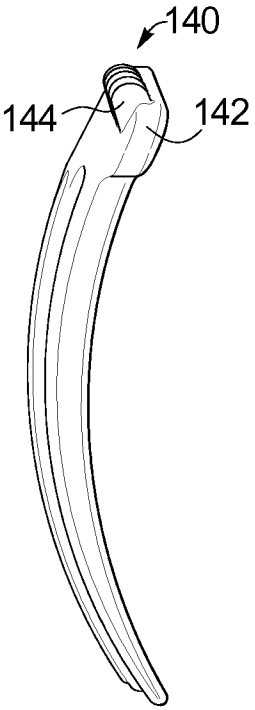
FIG. 23 shows a side view of another example of a comb for a hairstyling accessory according to the teachings of the invention.
Figure 22:
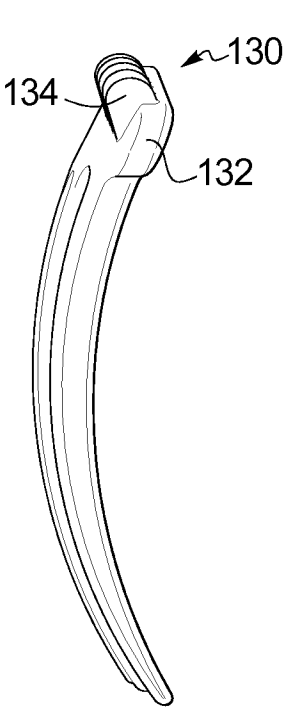
FIG. 22 shows a side view of another example of a comb for a hairstyling accessory according to the teachings of the invention.
Figure 21:
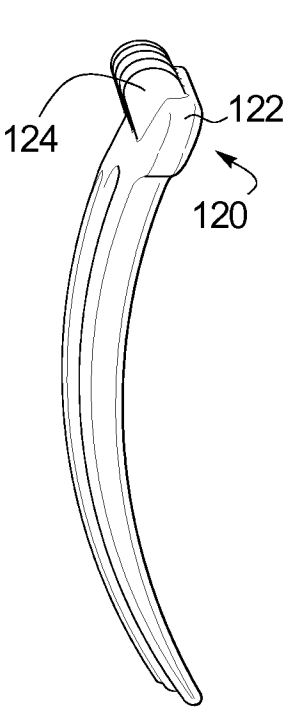
FIG. 21 shows a side view of another example of a comb for a hairstyling accessory according to the teachings of the invention.

In another example, the size of the fins can vary. FIGS. 21-23 show three different combs 120, 130, and 140 for alternate hairstyling accessory examples. Each comb has a bridge 122, 132, and 142 with fins 124, 134, 144. As can be seen, the fins 124 are larger than the earlier described fins 80 and the fins 134 are smaller than the fins 124 and 80. Likewise, the fins 144 are smaller than all of the fins 80, 124, and 134. The fin size can depend on the type of hair (thick, medium, thin, or the like) for which the hairstyling accessories 120, 130, 140 are intended. Though not shown herein, the width, length, spacing, peripheral edge shape and contour, and/or quantity of fins, if provided, can also vary for different hair types. Likewise, the spacing and thickness of the tines 46 can also vary, though not illustrated herein, as can the quantity of tines.

Though also not shown herein, the elastic band 34 does not have to be a braided elastic band that is removably connected as described above. The band can take on other forms and constructions and/or can be attached to the comb 32 in different ways from that disclosed above. For example, the elastic band can be a molded material that is over-molded onto the comb 32 resin to provide a permanent connection between the two components and to provide the ability to stretch the elastic around a ponytail. The elastic band material can thus be an injection molded elastomer such as TPE, TPU, PVA, or a number of other soft, highly elastic elastomers available in the marketplace. The elastic material or band also does have to form a closed loop. The elastic band 34 could possess a "ball-and-socket" type joint to snap two ends of a discontinuous band together or to snap the elastic band end or ends onto the comb 32 via at least one or more attachment points. Alternatively, the connection can be of a "zip-tie" type where the elastic band is drawn through an orifice in the comb that ratchets a ribbed elastic band that adjusts to the amount of hair being bound in a ponytail.

In another example, the back of the comb can be altered to allow for the elastic band to be glued to the comb instead of being removable and replaceable. For example, the bridge can have a blind slot or groove having a U-shape with a depth of about half that of the thickness of the elastic band. An adhesive, such as Cyanoacrylate glue, can be used to adhere or secure the elastic band to the comb. This would allow the hairstyling accessory to function as intended, but would not provide a simple way to remove and replace the band, if needed.

In the disclosed example, the opening 64 is also sized so that the elastic band 34 will not easily dislodge from the connector 60 once installed. This is accomplished by the opening size being smaller than the diameter of the elastic band material. The gaps on the sides 66 of the tongue 62 in this example are such that the elastic band can be threaded through one side or the other, but only by use of a bit of force to compress the elastic band material. The gap at the free end 68 of the tongue 62 is smaller still, so once the band is installed and hooked around the tongue, it will not easily fit over the free end and escape the opening 64 or the connector 60. The opening configuration and size can vary and yet function as intended and can do so to accommodate a particular sized elastic band material. In one example, the gap at the free end 68 of the tongue 62 can be about half that at the sides 66. If desired, a larger width portion can be provided at the top of the opening 64 at each side 66. This can allow the elastic band to fit freely in this part of the opening, once installed, so as to be in position aligned with the first groove 70 and the second grooves 72. The gap size below these larger portions being smaller can also help retain the elastic band 34 on the comb 32.

Figure 19:
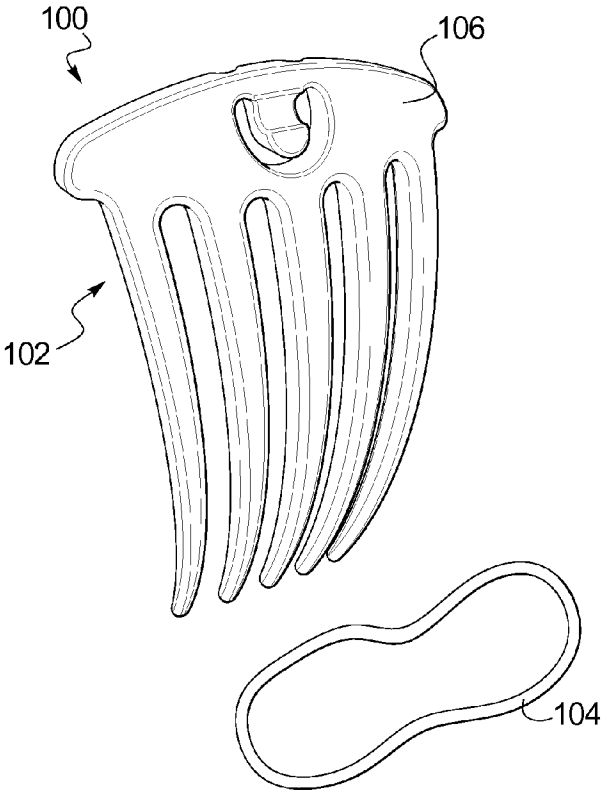
FIG. 19 shows a perspective view of another example of a comb for a hairstyling accessory according to the teachings of the invention.
Figure 20:
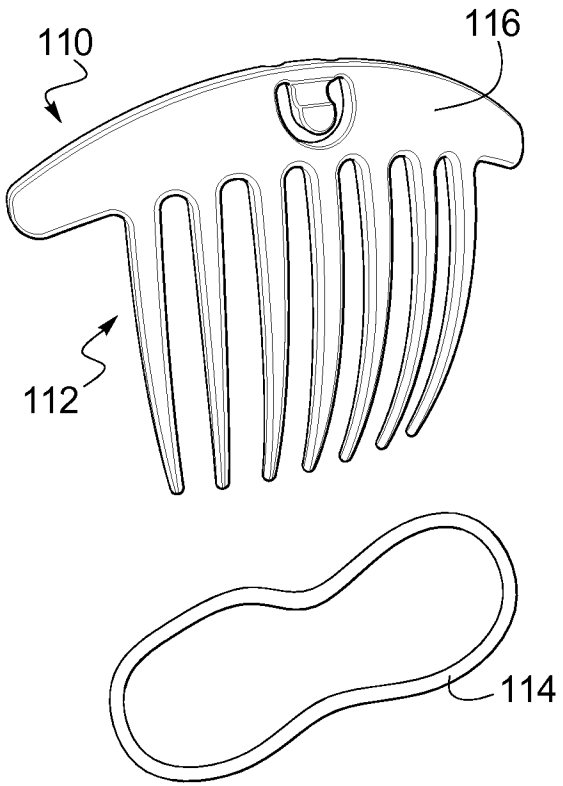
FIG. 20 shows a perspective view of another example of a comb for a hairstyling accessory according to the teachings of the invention.

The disclosed hair accessories can be used to produce a high volume of "volume up" ponytail hairstyle as shown in FIGS. 18 and 19. The hair accessories can be used to spread out the hair of the ponytail and also to elevate or lift a portion of the hair. The disclosed hair accessories can create a ponytail hairstyle and can do so more easily while achieving and holding a volume enhanced ponytail hair style in comparison to the prior known accessories and methods.

The connection between the comb and elastic band of the hairstyling accessories disclosed herein is an improvement over prior known solutions, such as the commercially available product embodied by FIGS. 7-9B in the above-noted '900 patent. The design of the disclosed comb and elastic band is installed behind the wrapped elastic band the gathered hair of a ponytail without having to worry about the comb sliding out of the hair, which is a problem with the '900 patented "hook" comb structure and other similar prior art structures.

The disclosed hairstyling accessories also assist in keeping the elastic band and comb components secured together so that a user does not inadvertently lose the band. However, should the elastic band break, the user can easily replace the band. The combs disclosed herein are somewhat traditional in construction, except that the connector and optional fins have been added. However, these additions to an otherwise conventional comb structure greatly improve the function and performance of the hairstyling accessory.

The disclosed combs are also contoured to be comfortable for a person to install and to wear. The combs are curved or contoured in two directions including laterally across the bridge and across the width of the tines and also lengthwise over a length of the tines and comb. When the comb contacts a wearer's scalp, the tines would not induce pain as a result of the tines or bridge pressing against their head. The dual curvature also helps to install the comb because of the comb following the natural curvature of the user's head.

The length, thickness, taper, angle, curvature, and/or number of tines can also vary and need not be limited to five, six, or seven tines. The quantity of tines can depend on the specific hairstyle or hair type that the accessory is intended to accommodate. The tines can have surface contours, ridges, twists, serrations, or the like that may aid in installing the comb and/or in securing the comb into the user's hair. The surface of the comb or portions thereof can be polished to allow easy installation. The surface of the comb or portions thereof can possess areas of texture or over-molded soft materials to increase friction in regions of the comb to assist in the comb holding the hair to prevent it from sliding once installed. The combs can be manufactured with an ABS resin and then painted with a metallic color to match various blond and brunette hair colors or can be molded of different color plastics to achieve a similar result. The elastic bands can be braided elastic with a shimmer sheen aesthetic added to the thread material to also closely match the blond and brunette hair colors.

Although certain hairstyling accessories, components, and methods have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A hairstyling accessory comprising:

a comb having a bridge extending laterally across the comb and a plurality of tines protruding longitudinally from the bridge and spaced apart from one another;

an elastic band; and a connector having a U-shaped opening through the bridge and a tongue coinciding within the opening, wherein a portion of the elastic band is received in the opening and around the tongue and the majority of the elastic band extends from the comb.

2. A hairstyling accessory according to claim 1, wherein the tongue projects partially across the opening giving the opening the U-shape.

3. A hairstyling accessory according to claim 1, further comprising:

a plurality of fins protruding from a surface of the bridge in a direction different than the tines.

4. A hairstyling accessory according to claim 1, wherein the plurality of tines each has a rounded edge contour.

5. A hairstyling accessory according to claim 1, wherein the bridge is curved about the longitudinal axis of the comb.

6. A hairstyling accessory according to claim 1, wherein the plurality of tines are curved in a direction end to end over their length.

7. A hairstyling accessory according to claim 1, wherein the tongue projects across the opening producing the U-shape and wherein the opening has side portions along sides of the tongue and an end portion at a free end of the tongue, the side portions being wider than the end portion.

8. A hairstyling accessory according to claim 7, wherein the elastic band has a cross-section diameter that is larger than at least that of the end portion.

9. A hairstyling accessory according to claim 1, wherein the tongue is oriented generally parallel to the plurality of tines.

10. A hairstyling accessory comprising:

a comb having a bridge extending laterally across the comb and a plurality of tines protruding longitudinally from the bridge and spaced apart from one another;

an elastic band; and a connector having an opening on the bridge and a tongue coinciding within the opening, wherein a portion of the elastic band is received in the opening and around the tongue and the majority of the elastic band extends from the comb, and wherein the connector has a groove formed across a base of the tongue on one side and wherein the portion of the elastic band lies in the groove.

11. A hairstyling accessory, comprising:

a comb having a bridge extending laterally across the comb and a plurality of tines protruding longitudinally from the bridge and spaced apart from one another;

an elastic band; and a connector having an opening on the bridge and a tongue coinciding within the opening, wherein a portion of the elastic band is received in the opening and around the tongue and the majority of the elastic band extends from the comb, and wherein a surface of the bridge has two grooves spaced apart from one another adjacent the connector and wherein segments of the elastic band lie in the two grooves.

12. A hairstyling accessory according to claim 11, wherein the two grooves are generally parallel to the plurality of tines.

13. A hairstyling accessory according to claim 11, wherein the connector has a tongue groove formed across a base of the tongue on a side of the comb opposite the two grooves and wherein the portion of the elastic band lies in the tongue groove.

14. A hairstyling accessory comprising:

a comb having a bridge extending laterally across the comb and a plurality of tines protruding longitudinally from the bridge and spaced apart from one another along the bridge;

a plurality of fins protruding from the bridge and spaced apart from one another over a length of the bridge, the plurality of fins protruding from the bridge in a different direction than the plurality of tines;

an elastic band;

a connector having an opening through the bridge and a tongue projecting partially across the opening;

two grooves on a surface of the bridge and spaced apart from one another adjacent the connector; and a tongue groove formed across a base of the tongue on a side of the comb opposite the two grooves, wherein a portion of the elastic band is received through the opening and around the tongue and a majority of the elastic band extends from the comb, and wherein the portion of the elastic band lies in the tongue groove and wherein segments of the elastic band lie in the two grooves.

15. A hairstyling accessory according to claim 14, wherein the plurality of fins each have a length greater than a width and are oriented lengthwise generally parallel with the plurality of tines.

16. A hairstyling accessory according to claim 14, wherein the two grooves are generally parallel to the plurality of tines and the tongue groove is generally perpendicular to the plurality of tines.

17. A hairstyling accessory according to claim 14, wherein the comb is formed as a one-piece molded plastic structure and the elastic band is removably replaceable on the comb.

18. A method of creating a ponytail hairstyle, the method comprising:

providing a comb having a bridge, a plurality of tines protruding longitudinally from and spaced apart from one another along the bridge, a U-shaped opening through the bridge, and a tongue that coincides with the opening; and instructing a user to insert a portion of an elastic band within the U-shaped opening on the bridge and around the tongue to connect the elastic band to the comb, to grasp a bundle of hair to be styled, to wrap the elastic band around the bundle of hair, to embed the plurality of tines into the hair under the bundle of hair, and to drape the bundle of hair over the comb.

* * * * *